US010295272B2

(12) United States Patent
O'Boyle

(10) Patent No.: US 10,295,272 B2
(45) Date of Patent: May 21, 2019

(54) ROTARY PRE-HEATER FOR HIGH TEMPERATURE OPERATION

(71) Applicant: ARVOS Inc., Wellsville, NY (US)

(72) Inventor: Jeffrey M. O'Boyle, Scottsville, NY (US)

(73) Assignee: ARVOS LJUNGSTROM LLC, Wellsville, NY (US)

( * ) Notice: Subject to any disclaimer, the term of this patent is extended or adjusted under 35 U.S.C. 154(b) by 0 days.

(21) Appl. No.: 15/091,200

(22) Filed: Apr. 5, 2016

(65) Prior Publication Data

US 2017/0284745 A1 Oct. 5, 2017

(51) Int. Cl.
*F28D 19/04* (2006.01)
*F28D 17/02* (2006.01)

(52) U.S. Cl.
CPC ..... *F28D 19/047* (2013.01); *F28D 17/023* (2013.01); *F28D 19/042* (2013.01); *F28D 19/044* (2013.01); *F24F 2203/108* (2013.01); *F24F 2203/1012* (2013.01); *F24F 2203/1072* (2013.01); *F24F 2203/1096* (2013.01); *F28F 2270/00* (2013.01)

(58) Field of Classification Search
CPC ..... F24F 2203/1012; F24F 2203/108; F24F 2203/1096; F24F 2203/1072; F28D 17/023; F28D 19/047; F28D 19/044; F28D 19/042
USPC ..... 165/8, 10
See application file for complete search history.

(56) References Cited

U.S. PATENT DOCUMENTS 2,680,598 A * 6/1954 Trulsson ..... F16J 15/54 165/9
2,803,508 A * 8/1957 Nilsson ..... F16C 19/10 165/9
2,936,160 A * 5/1960 Nilsson ..... F28D 19/048 165/8
2,981,521 A * 4/1961 Evans ..... F28D 19/047 165/7
3,108,632 A * 10/1963 Jensen ..... C21B 9/10 165/9
3,195,220 A * 7/1965 Martin ..... B23B 49/04 29/90.01

(Continued)

FOREIGN PATENT DOCUMENTS

CA 2406275 A1 * 11/2001 ..... F23L 15/02
GB 863901 A 3/1961

(Continued)

OTHER PUBLICATIONS

International Search Report for corresponding PCT/US2017/026176 dated Jul. 21, 2017.

(Continued)

*Primary Examiner* — Cassey D Bauer
*Assistant Examiner* — Jenna M Hopkins
(74) *Attorney, Agent, or Firm* — Murtha Cullina LLP

(57) ABSTRACT

An insulation retaining assembly for a high temperature rotary pre-heater having a cold-end rotor and a hot-end rotor includes a plurality of elongate retainer elements. Each of the retainer elements has a root end adapted to be held in fixed relationship to the cold-end rotor and a distal end proximate to the hot-end rotor. Portions of each of the plurality of retainer elements are adapted for circumferential movement.

14 Claims, 12 Drawing Sheets

(56) References Cited

U.S. PATENT DOCUMENTS 3,216,486 A * 11/1965 Hall ..... F28D 19/048 165/10
3,216,488 A * 11/1965 Conde ..... F28D 19/047 165/9
3,267,562 A * 8/1966 Casagrande ..... B21D 53/02 165/6
3,391,727 A 7/1968 Topouzian
3,467,174 A * 9/1969 Hart ..... F28D 19/045 165/10
3,545,532 A * 12/1970 Waitkus ..... F28D 19/047 165/10
3,601,182 A * 8/1971 Rao ..... F28D 19/041 165/10
3,915,220 A * 10/1975 Gibson ..... F28D 19/044 165/10
4,093,435 A * 6/1978 Marron ..... B01D 53/26 165/10
4,209,060 A * 6/1980 Wiking ..... F28D 19/044 165/10
4,313,489 A * 2/1982 Stockman ..... F28D 19/047 165/11.1
4,316,499 A * 2/1982 Schlageter ..... F28D 19/047 165/10
4,337,819 A 7/1982 Phillips
4,673,026 A * 6/1987 Hagar ..... F28D 19/047 165/7
4,838,342 A * 6/1989 Goetschius ..... F28D 19/044 165/10
5,119,885 A * 6/1992 Johnson ..... F28D 19/044 165/10
5,363,903 A * 11/1994 Hagar ..... F28D 19/047 165/8
5,836,378 A * 11/1998 Brophy ..... F28D 19/044 165/9
6,155,334 A * 12/2000 Steele ..... F24F 3/1423 165/10
6,257,318 B1 * 7/2001 Fierle ..... F23L 15/02 165/10
6,260,606 B1 * 7/2001 Fierle ..... F28D 19/044 165/10
6,397,785 B1 * 6/2002 Fierle ..... F23L 15/02 122/1 A
6,422,298 B1 * 7/2002 Rhodes ..... F28D 19/044 165/4
6,422,299 B1 7/2002 Eriksson
6,516,871 B1 * 2/2003 Brown ..... F28D 19/044 165/10
6,527,837 B2 * 3/2003 Kurosawa ..... B01D 53/06 55/502
6,581,676 B2 * 6/2003 Fierle ..... F23L 15/02 165/8
6,640,752 B1 * 11/2003 Counterman ..... F23J 15/003 122/1 A
6,640,880 B1 * 11/2003 Slocum ..... F23L 15/02 165/10
6,672,369 B1 * 1/2004 Brophy ..... F23L 15/02 165/10
6,789,605 B1 * 9/2004 Kaser ..... F23L 15/02 165/8
7,082,987 B2 * 8/2006 Hamilton ..... F28D 19/044 165/10
8,327,919 B2 * 12/2012 Slocum ..... F23L 15/02 165/8
2001/0026110 A1 * 10/2001 Kurosawa ..... B01D 53/06 310/261.1
2002/0124991 A1 * 9/2002 Wilson ..... F02C 7/105 165/8
2008/0245500 A1 * 10/2008 Childs ..... F28D 19/044 165/8
2013/0327495 A1 * 12/2013 Hastings ..... F23L 15/02 165/9
2014/0174560 A1 * 6/2014 Hastings ..... F16J 15/16 137/384

FOREIGN PATENT DOCUMENTS

GB 1017774 A 1/1966
JP S54-78956 U 6/1979
JP 2013132603 A * 7/2013 ..... B01D 53/06

OTHER PUBLICATIONS

International Search Report for corresponding PCT/US2017/026187 dated Jul. 21, 2017.

* cited by examiner

ROTARY PRE-HEATER FOR HIGH TEMPERATURE OPERATION

FIELD OF THE INVENTION

The present invention relates generally to a rotary pre-heater for high temperature operation, and more particularly to an insulation retaining assembly and a high temperature rotor configuration, both of which can withstand high temperature operation.

BACKGROUND OF THE INVENTION

Rotary regenerative heat exchangers or pre-heaters are commonly used to recover heat from various combustion and chemical reaction processes, including those associated with the production of synthesis gas (also referred to as Syngas). Conventional rotary regenerative heat exchangers have a rotor mounted in a housing that defines an inlet duct and an outlet duct for the flow of heated flue gases through the heat exchanger. The housing further defines another set of inlet ducts and outlet ducts for the flow of gas streams that receive the recovered heat energy. The rotor has radial partitions or diaphragms defining compartments therebetween for supporting baskets or frames to hold heat transfer sheets. Typically, the rotor and baskets are manufactured from a metallic materials.

However, in very high temperature applications (e.g., temperatures exceeding 2100 degrees Fahrenheit (1149 degrees Celsius)), for example in Syngas production systems, typical rotary regenerative heat exchangers have insufficient strength and oxidation can occur on the surfaces thereof. As a result, typical rotary regenerative heat exchangers can fail to operate at such high temperatures.

Thus, there is a need for an improved rotary pre-heater that can withstand high temperature operation.

SUMMARY

There is disclosed herein an insulation retaining assembly for a high temperature rotary pre-heater having a cold-end rotor and a hot-end rotor. The insulation retaining assembly includes a plurality of elongate retainer elements. Each of the retainer elements has a root end adapted to be held in fixed relationship to the cold-end rotor and a distal end proximate to the hot-end rotor. Portions of each of the plurality of retainer elements are adapted for circumferential movement.

In one embodiment, each of the plurality of retainer elements has a first connection area at the root end and a second connection area at the distal end. The insulation retaining assembly includes a plurality of groups of retainer elements. Each of the plurality of groups includes two or more of the retainer elements. Adjacent retainer elements in each of the groups are secured to one another at the first connection area and the second connection area. Adjacent groups are secured to one another at the first connection area, thereby forming a closed loop about a central axis to preclude circumferential movement of adjacent groups of groups of retainer elements relative to one another or relative to the cold end rotor. Adjacent groups are separate from one another outside of the first connection area so that each the groups is moveable in a circumferential direction about the central axis.

In one embodiment, each of the plurality of the retainer elements has an L-shaped configuration defining a first leg and a second leg. The second leg is shorter than the first leg and extends radially inward from the first leg.

In one embodiment, the first connection area is positioned on a first end of the first leg and the second connection area is positioned on a second end of the second leg.

There is further disclosed herein a rotor for a high temperature rotary pre-heater. The rotor includes a hub having an exterior surface with a plurality of first pockets (e.g., axial slots) formed therein. The rotor includes an annular rim positioned around and coaxially with the hub. The annular rim has an interior surface with a corresponding plurality of second pockets (e.g., axial slots) formed therein. A plurality of spokes extend between the hub and the annular rim. Each of the plurality of spokes has a first terminal end and a second terminal end. The first terminal end is seated in a respective one of the plurality of first pockets and the second terminal end is seated in a respective one of the plurality of second pockets. A first ceramic fiber blanket is disposed between: 1) the first terminal end and the respective one of the first pockets; and/or the second terminal end and the respective one of the second pockets.

In one embodiment, the first ceramic fiber blanket is adhered to the first terminal end and/or the second terminal end with a sacrificial adhesive facilitating the spokes to be keyed into their corresponding pockets during assembly.

In one embodiment, the hub, the annular rim and/or one or more of the plurality of spokes is manufactured from a ceramic material.

In one embodiment, a channel member is disposed on the first terminal end and/or the second terminal end. The first ceramic fiber blanket is disposed on the channel member.

In one embodiment, a channel member is disposed on the first ceramic fiber blanket. The channel member includes two segments, either joined to one another or not attached to one another. Each of the channel members has an L-shaped cross section and a portion of each of the two segments overlap each other.

In one embodiment, the rotor includes an insulation assembly surrounding an exterior surface defined by the annular rim. The insulation assembly includes a second ceramic blanket that engages the exterior surface. The insulation assembly includes an insulation retaining assembly that engages and retains the second ceramic blanket. The insulation retaining assembly includes a plurality of elongate retainer elements. Each of the retainer elements has a root end adapted to be held in fixed relationship (e.g., no or essentially no circumferential movement of the root end) to the cold-end rotor and a distal end proximate to the hot-end rotor. Portions of each of the plurality of retainer elements are adapted for circumferential movement.

In one embodiment, each of the plurality of retainer elements has a first connection area at the root end and a second connection area at the distal end. The insulation retaining assembly includes a plurality of groups of retainer elements. Each of the plurality of groups includes two or more of the retainer elements. Adjacent retainer elements in each of the groups are secured to one another at the first connection area and the second connection area. Adjacent groups are secured to one another at the first connection area, thereby forming a closed loop about a central axis to preclude circumferential movement of adjacent groups of groups of retainer elements relative to one another or relative to the cold end rotor. Adjacent groups are separate from one another outside of the first connection area so that each the groups is moveable in a circumferential direction about the central axis.

In one embodiment, each of the plurality of the retainer elements has an L-shaped configuration defining a first leg and a second leg. The second leg is shorter than the first leg and extends radially inward from the first leg.

In one embodiment, the first connection area is positioned on a first end of the first leg and the second connection area is positioned on a second end of the second leg.

There is further disclosed herein a rotary pre-heater. The rotary pre-heater includes an annular housing, a hot-end connecting plate, a cold-end connecting plate and a rotor. The hot-end connecting plate has a first inlet and a first outlet and is secured to a first axial end of the annular housing. The cold-end connecting plate has a second inlet and a second outlet and is secured to a second axial end of the annular housing. The rotor is disposed for rotation in the annular housing between the hot-end connecting plate and the cold-end connecting plate. The rotor includes a cold-end rotor mounted for rotation on a spindle proximate the cold-end connecting plate. The cold-end rotor has a first plurality of flow passages extending therethrough. The rotor includes a hot-end rotor assembly disposed on the cold-end rotor. The hot-end rotor assembly is proximate the hot-end connecting plate, the hot-end rotor assembly has a second plurality of flow passages extending therethrough. The hot end rotor includes a hub that has an exterior surface with a plurality of first pockets formed therein. The hot end rotor includes an annular rim positioned around and coaxially with the hub. The annular rim has an interior surface with a corresponding plurality of second pockets formed therein. The hot end rotor includes a plurality of spokes, extending between the hub and the annular rim. Each of the plurality of spokes has a first terminal end and a second terminal end. The first terminal end is seated in a respective one of the plurality of first pockets and the second terminal end is seated in a respective one of the plurality of second pockets. A first ceramic fiber blanket is disposed between: 1) the first terminal end and the respective one of the first pockets; and/or the second terminal end and the respective one of the second pockets.

There is also disclosed herein another rotary pre-heater. The rotary pre-heater includes an annular housing, a hot-end connecting plate, a cold-end connecting plate and a rotor. The hot-end connecting plate has a first inlet and a first outlet and is secured to a first axial end of the annular housing. The cold-end connecting plate has a second inlet and a second outlet and is secured to a second axial end of the annular housing. The rotor is disposed for rotation in the annular housing between the hot-end connecting plate and the cold-end connecting plate. The rotor includes a cold-end rotor mounted for rotation on a spindle proximate the cold-end connecting plate. The cold-end rotor has a first plurality of flow passages extending therethrough. The rotor includes a hot-end rotor assembly disposed on the cold-end rotor. The hot-end rotor assembly is proximate the hot-end connecting plate, the hot-end rotor assembly has a second plurality of flow passages extending therethrough. The rotor includes an insulation assembly surrounding an exterior surface defined by the annular rim.

The insulation retaining assembly includes a plurality of elongate retainer elements. Each of the retainer elements has a root end adapted to be held in fixed relationship (e.g., no or essentially no circumferential movement of the root end) to the cold-end rotor and a distal end proximate to the hot-end rotor. Portions of each of plurality of retainer elements are adapted for circumferential movement.

In one embodiment, each of the plurality of retainer elements has a first connection area at the root end and a second connection area at the distal end. The insulation retaining assembly includes a plurality of groups of retainer elements. Each of the plurality of groups includes two or more of the retainer elements. Adjacent retainer elements in each of the groups are secured to one another at the first connection area and the second connection area. Adjacent groups are secured to one another at the first connection area, thereby forming a closed loop about a central axis to preclude circumferential movement of adjacent groups of groups of retainer elements relative to one another or relative to the cold end rotor. Adjacent groups are separate from one another outside of the first connection area so that each the groups is moveable in a circumferential direction about the central axis.

DETAILED DESCRIPTION

Figure 1:
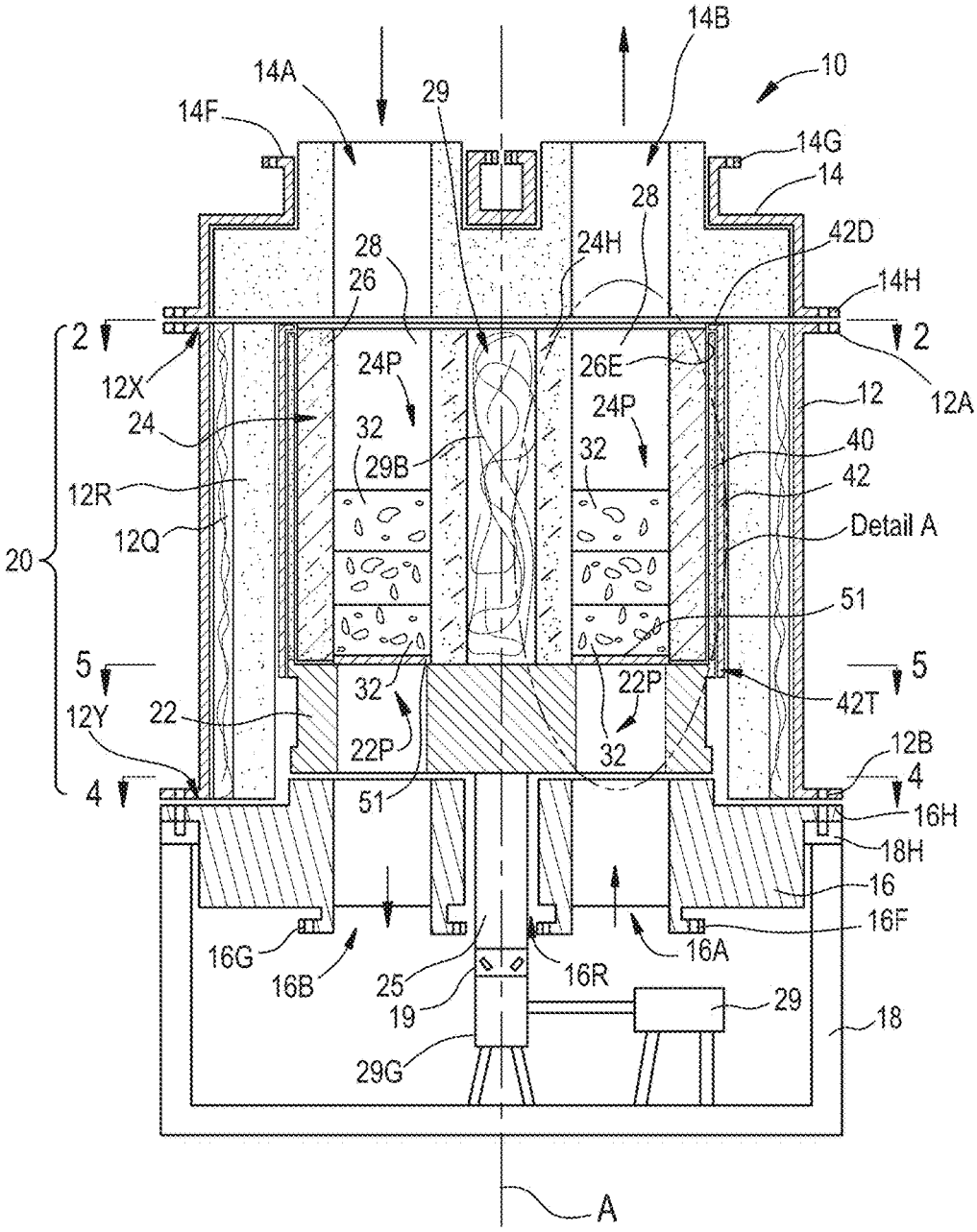
FIG. 1 is a cross sectional view of the rotary pre-heater of the present invention.

As shown in FIG. 1, a rotary pre-heater for high temperature operation is generally designated by the numeral 10. The rotary pre-heater 10 is suitable for use in the production of Syngas, or synthesis gas, which is a fuel gas mixture consisting primarily of hydrogen, carbon monoxide, and some carbon dioxide. The rotary pre-heater 10 has a generally annular housing 12 that extends between a hot-end flange 12A formed at a first axial end 12X of the annular housing 12 and a cold-end flange 12B formed at a second axial end 12Y of the annular housing 12. The annular housing 12 is lined with a suitable refractory 12R (e.g., a ceramic based refractory) wrapped in a ceramic fiber blanket 12Q providing thermal insulation between the refractory 12R and housing 12.

As shown in FIG. 1, the rotary pre-heater 10 includes a hot-end connecting plate 14 having a first inlet 14A defined by a flange 14F and a first outlet 14B defined by a flange 14G. The hot-end connecting plate 14 is associated with a hot side of the rotary pre-heater 10 into which hot gases (e.g., 2100 degrees Fahrenheit (1149 degrees Celsius)) depleted in oxygen flow via the first inlet 14A. The hot-end connecting plate 14 has a flange 14H formed on an axial end thereof, opposite the first inlet 14A and the first outlet 14B. The flange 14H of the hot-end connecting plate 14 is secured to the hot-end flange 12A of the annular housing 12 via suitable fasteners (not shown).

Figure 4:
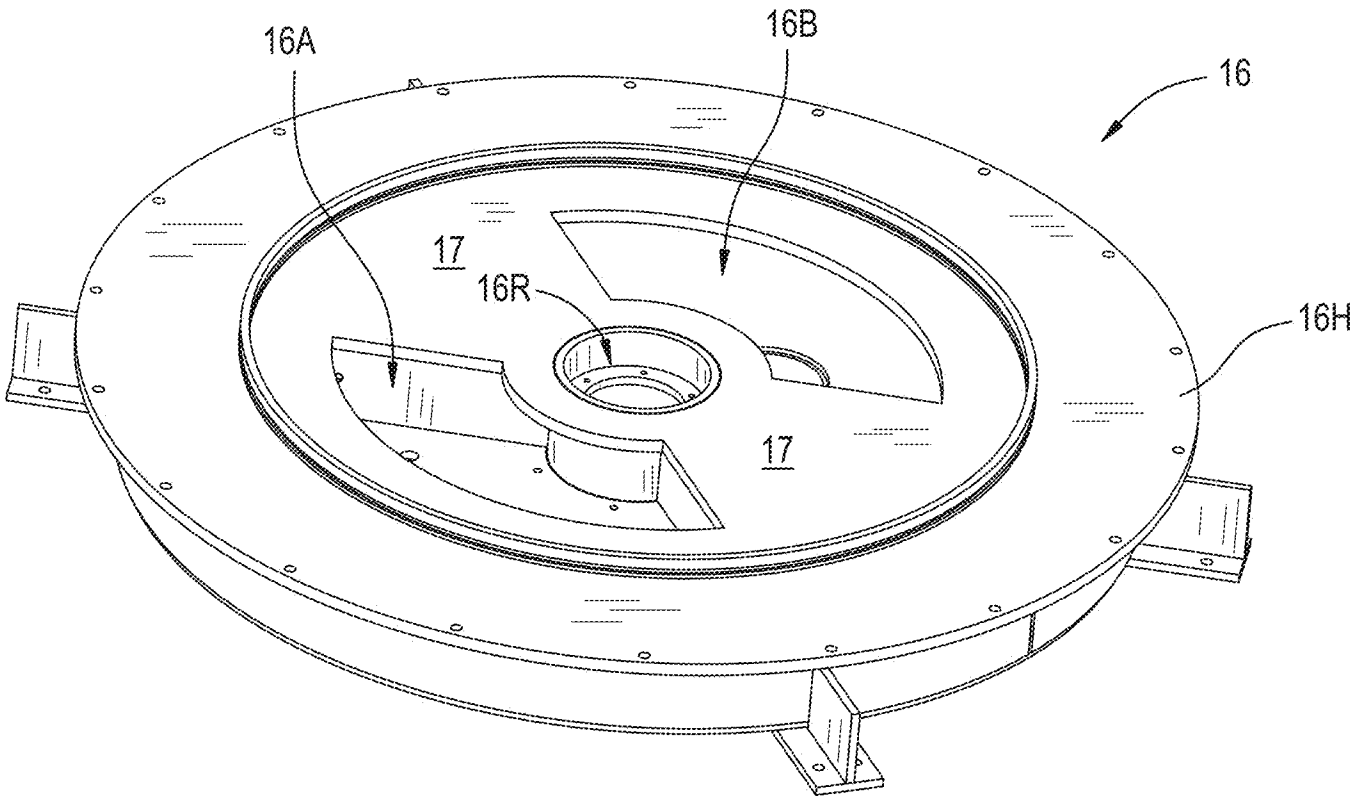
FIG. 4 is a perspective view of the cold-side connecting plate taken across line 4-4 of FIG. 1.

As shown in FIGS. 1 and 4, the rotary pre-heater 10 includes a cold-end connecting plate 16 having a second inlet 16A defined by a flange 16F and a second outlet 16B defined by a flange 16G. The cold-end connecting plate 16 is associated with a cold side of the rotary pre-heater 10 into which cold air to be heated flows via the second inlet 16A. The cold-end connecting plate 16 has a flange 16H formed on an axial end thereof, opposite the second inlet 16A and the second outlet 16B. The flange 16H of the cold-end connecting plate 16 is secured to the flange 12B of the annular housing 12 and a flange 18H of a frame 18 via suitable fasteners (not shown). As shown in FIG. 4, the second inlet 16A of the cold-end connecting plate 16 is an arcuate segment; and the second outlet 16B is another arcuate segment. The arcuate segments define the second inlet 16A and the second outlet 16B are separated from one another by a flat plate segment 17. The cold-end connecting plate 16 has a centrally located bore 16R extending therethrough for receiving a spindle 25 as described further herein with reference to FIG. 1.

As shown in FIG. 1, a rotor 20 is disposed for rotation in the refractory lined annular housing 12 and axially between the hot-end connecting plate 14 and the cold-end connecting plate 16. The rotor 20 includes a cold-end rotor 22 mounted for rotation on the spindle 25 proximate the cold-end connecting plate 16. The spindle 25 is supported by a suitable bearing 19 (e.g., a tapered thrust bearing). A motor 29 is coupled to a gearbox 29G that is coupled to the spindle 25 for rotation of the rotor 20 relative to the annular housing 12.

Figure 5:
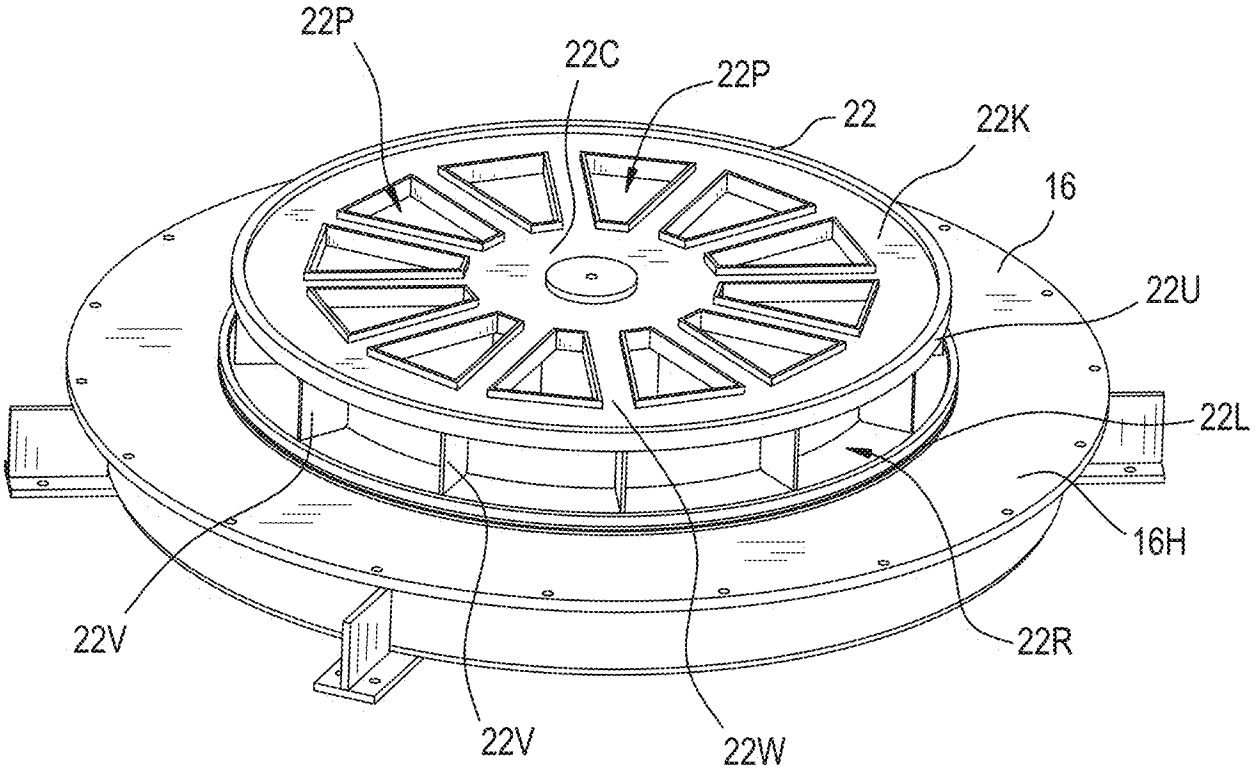
FIG. 5 is a perspective view of the cold-end rotor mounted on the cold side connecting plate taken across line 5-5 of FIG. 1.

As shown in FIGS. 1 and 5, the cold-end rotor 22 has a plurality of first flow passages 22P extending therethrough. Each of the first flow passages 22P has, for example in cross-section a trapezoidal shape and adjacent ones of the first flow passages 22P are separated by an elongate dividing wall 22W that forms along its upper end a first channel. For example, FIG. 5 illustrates twelve of the first flow passages 22P. The first flow passages 22P are smaller than the flat plate segment 17 of the cold-end connecting plate 16 to ensure isolation between the second flow inlet 16A and the second flow outlet 16B as the cold end rotor 22 rotates relative to the cold-end connecting plate 16. The cold-end rotor 22 has a second channel 22K configured as an annular shape and extending around the periphery of the first flow passages 22P. The cold-end rotor 22 has a third channel 22C configured as an annular shape and extending radially inwardly of the first flow passages 22P. The second channel 22K and third channel 22C are concentric and coaxial with the cold end rotor 22 and the spindle 25. The first channels each associated with and atop a respective one of the dividing walls 22W, the second channel 22K and the third channel 22C interconnect and communicate with one another and are configured in a hub, spoke and wheel socket configuration complementary to and mating with a hot-end rotor 24 as described further herein. The hub, spoke and wheel socket configuration increases the strength of the hot-end rotor assembly 24 at elevated temperatures (e.g., 2100 degrees Fahrenheit (1149 degrees Celsius)).

As shown in FIG. 5, the cold end rotor 22 has an upper flange area 22U extending circumferentially around an upper portion of the cold end rotor 22. The cold end rotor 22 has a lower flange area 22L extending circumferentially around a lower portion of the cold end rotor 22. The upper flange area 22U and the lower flange area 22L are separated by a recess 22R. A plurality of vanes 22V extend radially outward and are connected to the upper flange area 22U and the lower flange area 22L.

In one embodiment, the cold end rotor 22 is manufactured from a plain carbon steel and is adapted to operate at an average temperature of about 450 degrees Fahrenheit (232 degrees Celsius).

As shown in FIG. 1, the rotor 20 includes the hot-end rotor assembly 24 disposed on the cold-end rotor 22 and positioned proximate the hot-end connecting plate 14. The hot-end rotor assembly 24 has a plurality of second flow passages 24P extending therethrough. The hot end rotor 24 is configured in a hub, spoke and wheel configuration complementary to and mating with the socket configuration of the first channels associated with the dividing walls 22W, the second channel 22K and the third channel 22C.

Figure 2:
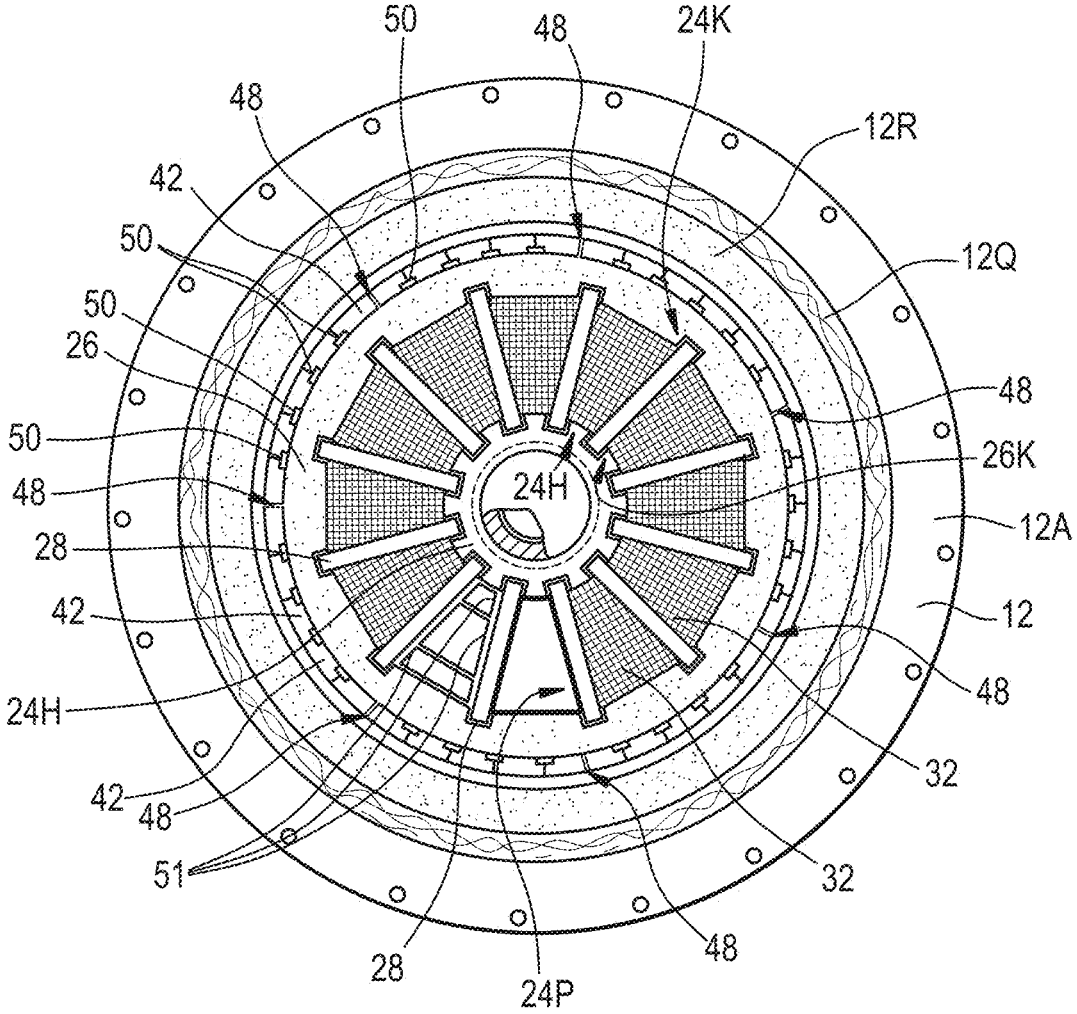
FIG. 2 a top cross sectional view of the rotary pre-heater of FIG. 1 taken across line 2-2.
Figure 3:
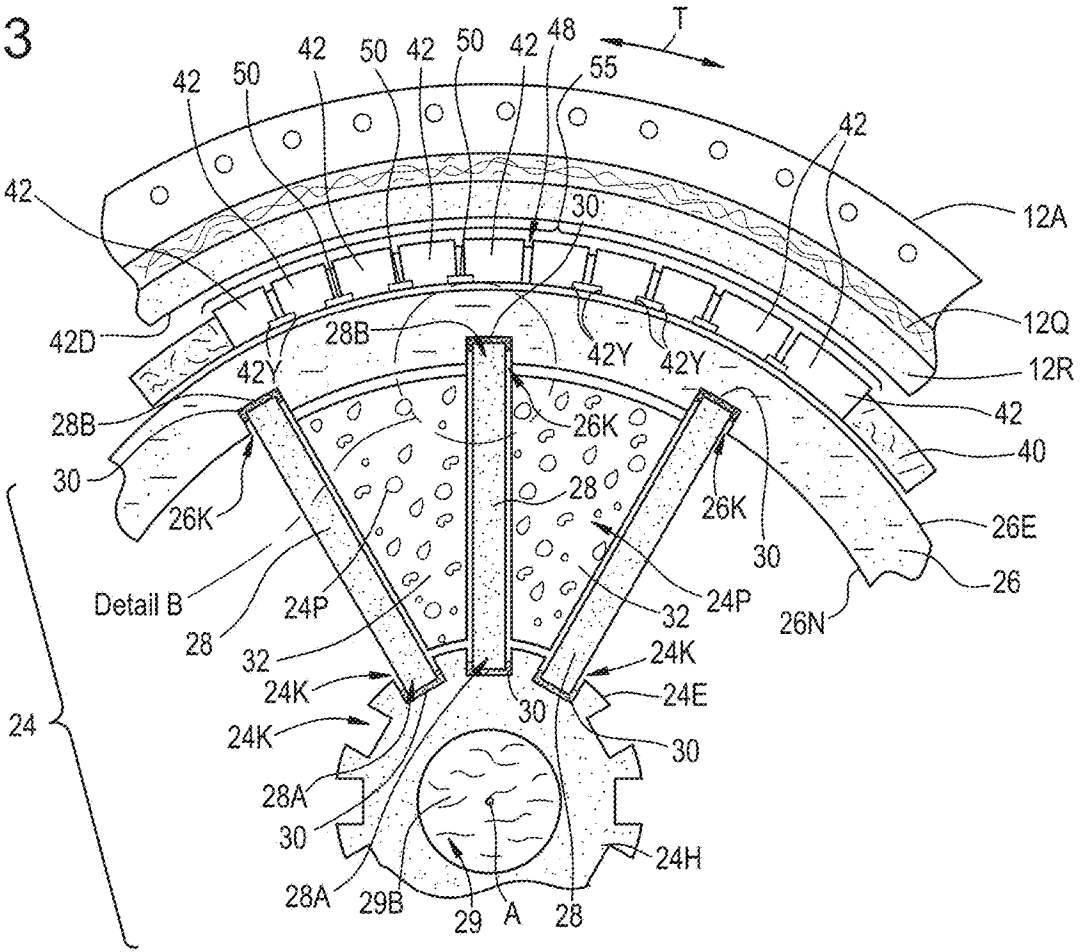
FIG. 3 is an enlarged view if a portion of the rotary pre-heater of FIG. 2.

As illustrated in FIGS. 2 and 3, the hot-end rotor assembly 24 has a hub 24H having an exterior surface 24E with a plurality of first pockets in the form of first axial slots 24K (e.g., rectangular shaped elongate axial oriented recesses) formed therein. The hub 24H has a bore 29 extending therethrough. In one embodiment, the bore 29 has a ceramic fiber blanket 29B disposed therein. The hot-end rotor assembly 24 has an annular rotor rim 26 positioned around and coaxially with the hub 24H. The rotor rim 26 has an interior surface 26N with a corresponding plurality of second pockets in the form of second axial slots 26K formed therein. The rotor rim 26 also defines a generally cylindrical exterior surface 26E.

As illustrated in FIGS. 2 and 3, the hot-end rotor assembly 24 includes a plurality of spokes 28, extending between the hub 24H and the rotor rim 26. Each of the plurality of spokes 28 has a first terminal end 28A and a second terminal end 28B. The first terminal end 28A is seated in one of the first axial slots 24K and the second terminal end 28B is seated in the corresponding one of the second axial slots 28B.

The spokes 28, the rotor rim 26, and/or the hub 24H are manufactured from a ceramic material, such as a ceramic casting. In one embodiment, the spokes 28, the rotor rim 26, and/or the hub 24H are manufactured from a sintered ceramic material.

Figure 11:
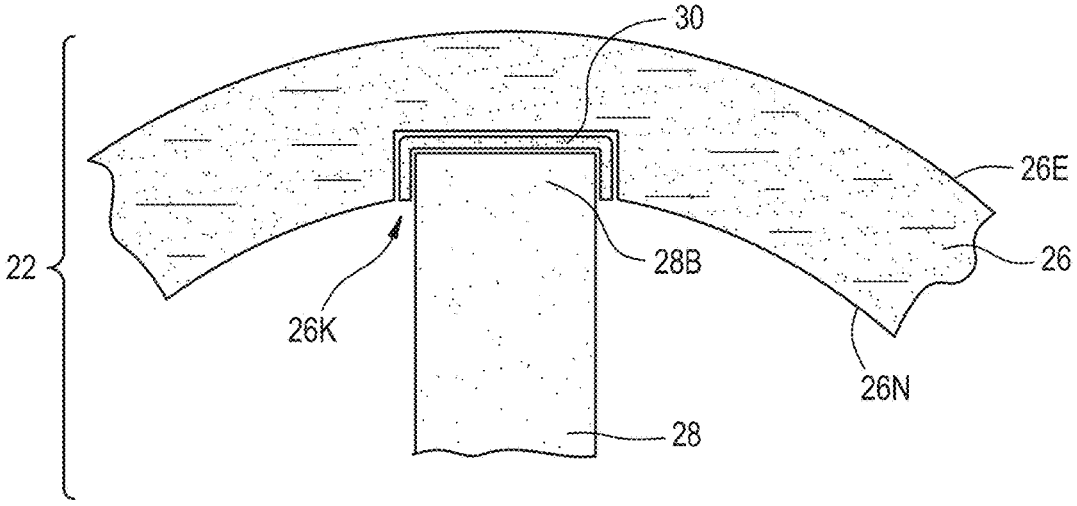
FIG. 11 is an enlarged view of a portion of the ceramic rotor portion of detail B of FIG. 2.

As illustrated in FIGS. 2 and 11, a ceramic fiber blanket 30 is disposed as packing material between the second terminal end 28B of the spoke 28 in one of the second slots 26K. As shown in FIG. 11, another ceramic fiber blanket 30 is disposed between the first terminal end 28A of the spoke 28 in one of the first slots 24K. The ceramic fiber blankets 30 are adhered to the respective one of the first terminal end 28A and the second terminal end 28B with a sacrificial adhesive to facilitate assembly. This facilitates the spokes 28 being keyed into their respective slots 24K during assembly of the hot-end rotor assembly 24. During operation, the sacrificial adhesive burns off. It will be appreciated that, while ceramic fiber blanket is the preferred packing material, any other suitable heat resistant material can be used, for example fibrous matting, felt or woven material.

Figure 12:
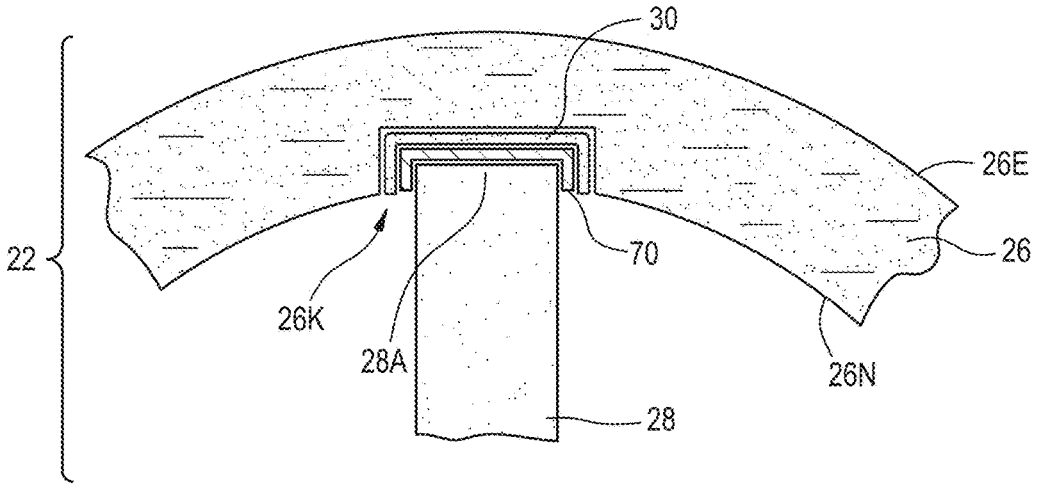
FIG. 12 is an enlarged view of a portion of another embodiment of the ceramic rotor portion of detail A of FIG. 2.
Figure 13:
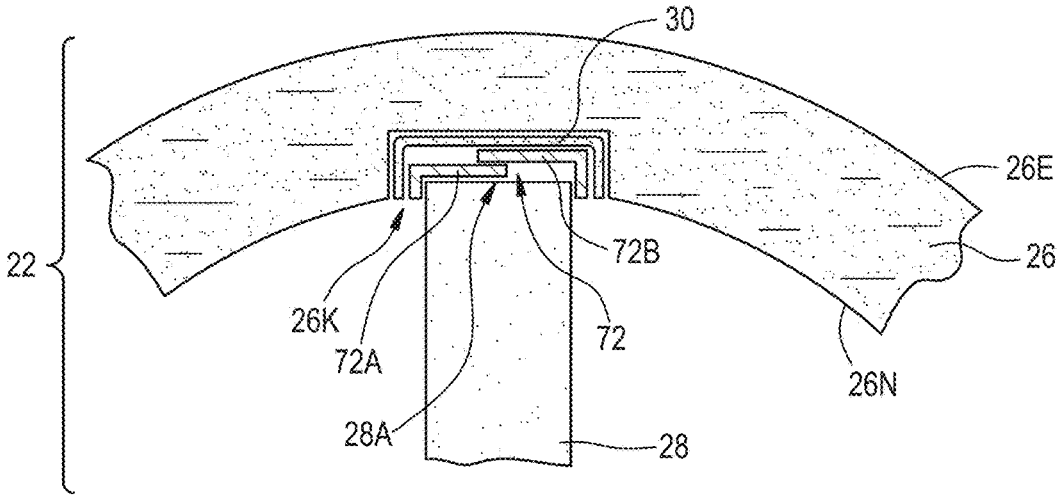
FIG. 13 is an enlarged view of a portion of yet another embodiment of the ceramic rotor portion of detail A of FIG. 2.

While the ceramic fiber blanket 30 is shown and described as being between the second terminal end 28B of the spoke 28 in one of the second slots 26K and/or another ceramic fiber blanket 30 is disposed between the first terminal end 28A of the spoke 28 in one of the first slots 24K, the present invention is not limited in this regard as other configurations may be employed including but not limited to the embodiments illustrated in FIGS. 12 and 13. For example, as illustrated in FIG. 12, a channel member 70 (e.g., a metallic or stainless steel channel) is disposed on a respective one or more of the first terminal end 28A and the second terminal end 28B; and the first ceramic fiber blanket 30 is disposed on (e.g., adhered to) the channel member 70. In one embodiment, the relative position of the channel member 70 and the ceramic fiber blanket may be reversed so that the ceramic fiber blanket 30 is disposed on a respective one or more of the first terminal end 28A and the second terminal end 28B and the channel 70 is disposed over the ceramic fiber blanket 30. The channel member 70 increases the strength of the hot-end rotor assembly 24 at elevated temperatures (e.g., 2100 degrees Fahrenheit (1149 degrees Celsius)).

In one embodiment, as illustrated in FIG. 13, a channel member 72 is defined by two segments 72A and 72B, each having an L-shaped cross section and a portion of each of the two segments 72A and 72B overlap each other. A ceramic fiber blanket 30 is positioned over the channel member 72. This embodiment permits the overlapping portions to slide one against the other to accommodate thermal expansion and contraction without applying any substantial circumferential loading to side walls of the respective slots 24K within which they are seated.

Figure 6:
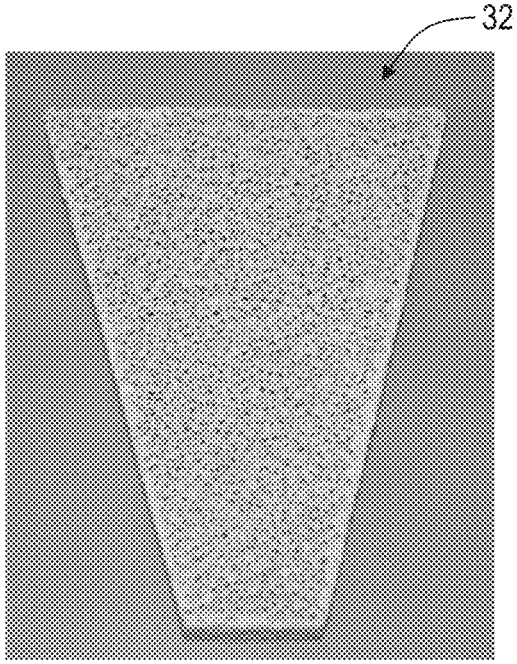
FIG. 6 is a schematic drawing of a ceramic heat transfer media section for installation in the hot-side rotor of FIG. 3.
Figure 7:
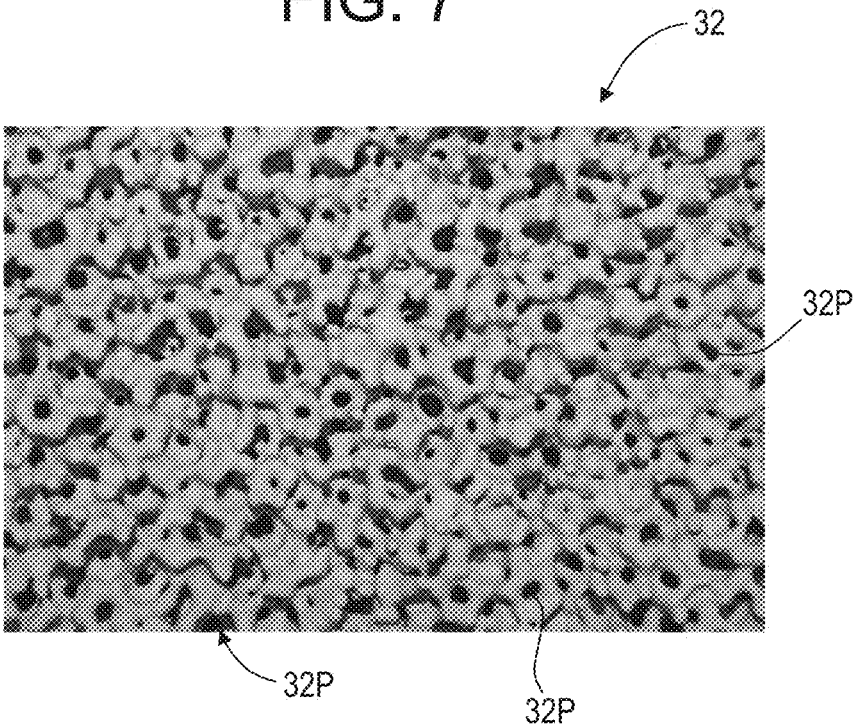
FIG. 7 is an enlarged view of a portion of the ceramic heat transfer media section of FIG. 6.

As shown in FIGS. 1 and 2, each of the flow passages 24P in the hot-end rotor assembly 24 has a stack of heat transfer plates 32 disposed therein and supported by a rack configuration 51. The heat transfer plates 32 are generally trapezoidal shaped (see FIG. 6) complementarily to the trapezoidal shape of the first flow passages 22P. The heat transfer plates 32 are made from a porous ceramic sponge-like material, such as cordierite, that has a plurality of open pores 32P extending therethrough as shown in FIG. 7.

Figure 8:
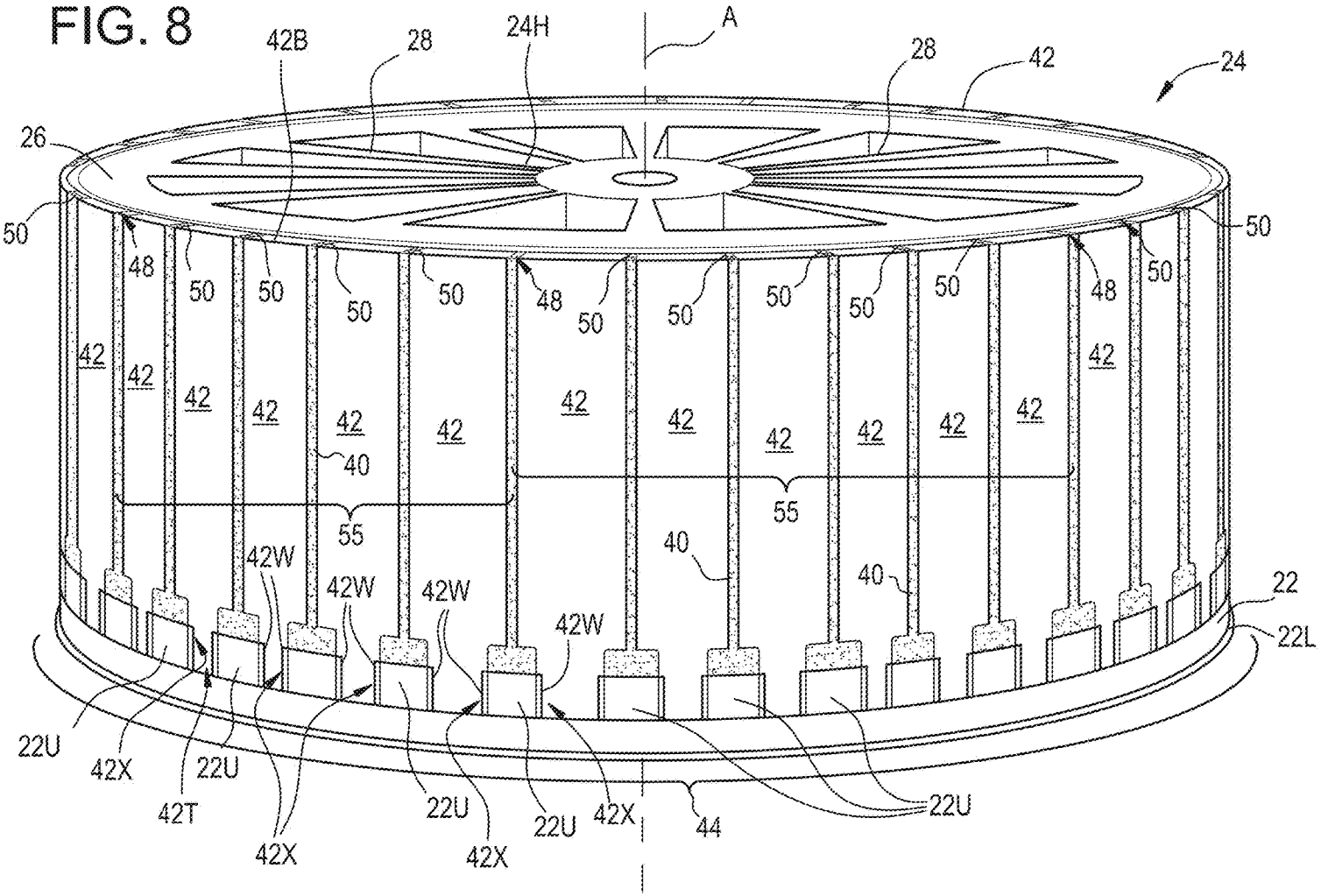
FIG. 8 is a perspective view of a ceramic rotor portion of the rotary pre-heater of FIG. 1.
Figure 9:
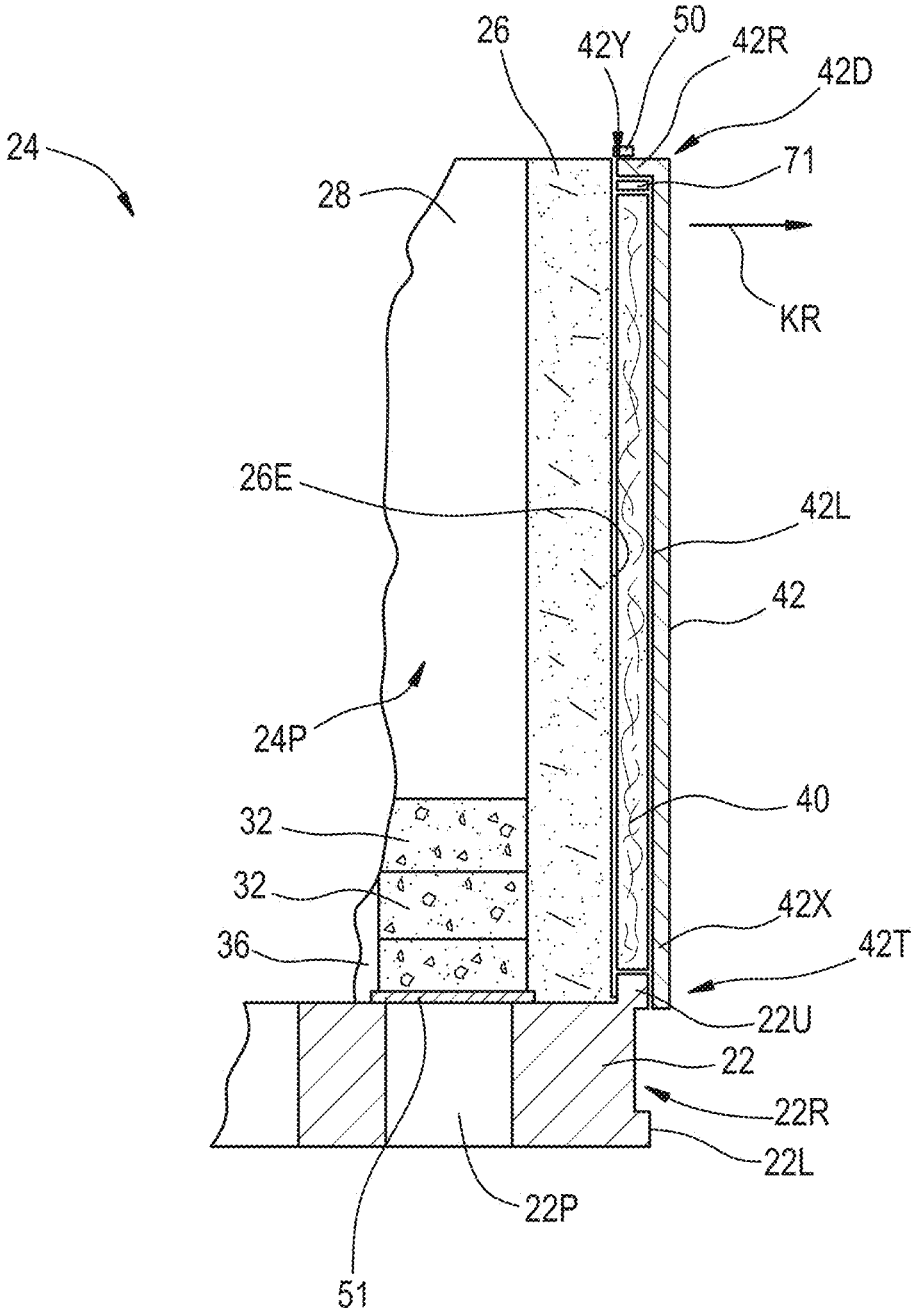
FIG. 9 is an enlarged view of detail A of FIG. 1.
Figure 10:
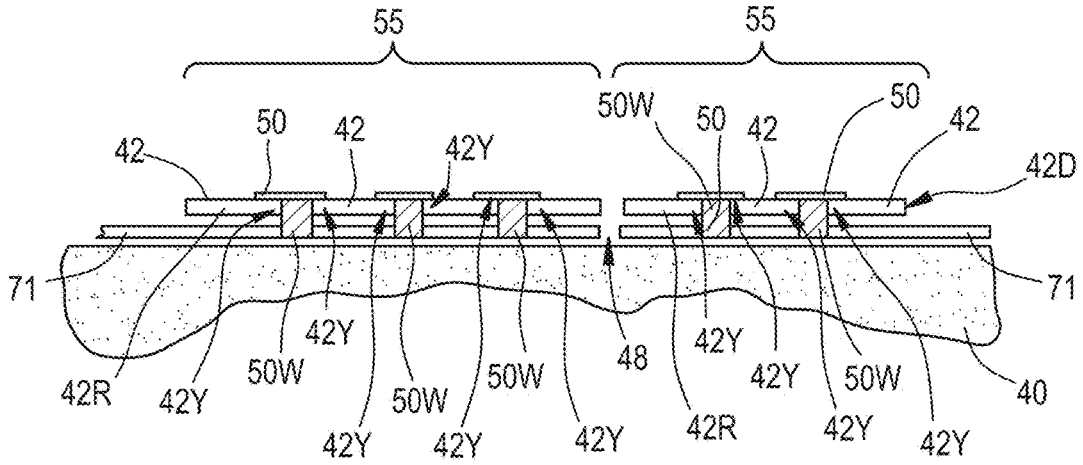
FIG. 10 is a detailed cross sectional view of a portion of two groups retainer elements.

As illustrated in FIGS. 1, 2 and 9, the rotor rim 26 has an insulation assembly surrounding the exterior surface 26E. The insulation assembly includes a ceramic fiber blanket 40 surrounding and in contact with the exterior surface 26E. As shown in FIGS. 2, 8 and 9, the insulation assembly includes an insulation retaining assembly 44 encapsulating the ceramic fiber blanket 40. The insulation retaining assembly 44 includes a plurality of elongate retainer elements 42. As shown in FIG. 9, each of the retainer elements 42 has a first connection area 42X at one root end 42T thereof (e.g., bottom end, or end adjacent to the cold-end rotor 22); and a second connection area 42Y at the other end (i.e., distal end 42D) thereof (e.g., an upper end or an end adjacent to the hot-end connection plate 14). In one embodiment, the retainer element 42 has an inverted L-shaped configuration defining an elongate first leg 42L (e.g., long leg) and a short second leg 42R (e.g., short leg), with the second leg 42R extending radially inward from the first leg 42L. As shown in FIG. 9, the second connection areas 42Y are positioned on a radially inward end of the second leg 42R. Each of the retainer elements 42 has two first connection areas 42X (as best shown in FIG. 8) and two second connection areas 42Y, as best shown in FIG. 10. As shown in FIG. 10, the second connection areas 42Y of adjacent retainer elements 42 of each group 55 of the retainer elements 42 are connected to one another by a weld 50W. A backing plate (e.g., an arcuate segment 71 of a circumferential length about equal to a length of the group 55 of retainer elements 42) is positioned under the short second leg 42R of the retainer elements 42. A connector plate 50 extends between adjacent ones of the short second leg 42R of the retainer elements 42. The connector plate 50, the short second leg 42R and portions of the backing plate 71 are connected to one another, for example, by the weld 50W. Thus, adjacent ones of second connection areas 42Y of adjacent retainer elements 42 of each group 55 of the retainer elements 42 are restrained from circumferential movement relative to one another.

While the connector plate 50, the short second leg 42R and portions of the backing plate 71 are shown and described as being connected to one another by the welds 50W the present invention is not limited in this regard as the adjacent retainer members 42, the connector plates 50, the short second legs 42R and/or portions of the backing plates 71 may be secured to one another at the second connection areas 42X or other suitable areas by suitable fasteners.

As shown in FIGS. 2 and 8, the insulation retaining assembly 44 includes a plurality of groups 55 of retainer elements 42. Each of the plurality of groups 55 have at least two of the retainer elements 42 connected to one another as described herein. For example, the groups 55 shown in FIG. 2, each have five of the adjacent retainer elements 42 secured to one another at the first connection area 42X and the second connection area 42Y. Collectively, these form a structurally stable arcuate section of bound together retainer elements 42 that can withstand the mechanical effects of thermal expansion and rotation typical during operation of the preheater. While the groups in FIG. 2 are shown and described as having five retainer elements 42, the present invention is not limited in this regard as at least two retainer elements 42 may be employed in each group 55. Alternatively, retainer elements 42 could be constructed from broad sheet material provided with an arcuate cross-sectional profile providing the requisite structural stability at the distal ends 42D thereof.

As shown in FIG. 8, the retainer elements 42 of each of the groups 55 are connected to the upper flange area 22U at the first connection areas 42X, for example by welds 42W joining the first connection areas 42X to the upper flange area 22U, thereby forming a closed loop about a central axis A such that there is no or essentially no circumferential movement of adjacent ones of the first connection areas 42X relative to one another or to the upper flange area 22U. While the retainer elements 42 are described as being connected to the upper flange area 22U at the first connection areas 42X by welds 42W, the present invention is not limited in this regard as the retainer elements 42 may be connected to the upper flange area 22U by other suitable means, such as but not limited to threaded fasteners extending therethrough and threaded into respective threaded bores in the upper flange area 22U.

Adjacent ones of the groups 55 of retainer elements 42 are separate from one another outside of the second connection area 42Y (e.g., are not connected to one another at the second connection areas 42Y) thereby forming a gap 48 between the retainer elements 42, the gap also being formed between adjacent groups 55 at the second connection areas 42Y. The gap 48 is a circumferential gap having a width that extends between at least one pair of the retainer elements 42. The gap 48 extends parallel to the central axis A, i.e., the gap 48 is axially extending between at least one pair of the retainer elements 42. Portions of each (i.e., portions extending away from the first connection areas 42X and away from the root ends 42T, such as the groups 55 of the second connection areas 42Y secured together and the distal ends 42D) of the groups 55 of retainer elements 42 are moveable in a circumferential direction as indicted by the arrows T in FIG. 3, in response to thermal expansion of the rotor rim 26 and/or the ceramic fiber blanket 40, while the arcuate shape of the groups 55 retains the ceramic fiber blanket 40 in a predetermined position (e.g., against the exterior surface 26E). However, each of the second connection areas 42Y, distal ends 42D and the portions extending away from the first connection areas 42X have essentially no radial movement in the direction of the arrow KR in FIG. 9, as a result of thermal expansion and heating of the rotor rim 26 and/or the ceramic fiber blanket 40. The movability of the retainer elements 42 in the circumferential direction prevents the retainer elements 42 from deflecting radially outward and prevents interference of the hot-end rotor assembly 24 with the refractory 12R during rotation of the hot-end rotor assembly 24 at elevated temperatures (e.g., 2100 degrees Fahrenheit (1149 degrees Celsius)).

In one embodiment, the retainer elements 42 are manufactured from a high alloy steel such as but not limited to a type 4562 nitrogen iron nickel chrome molybdenum alloy steel. In one embodiment, the retainer elements 42 are manufactured from the type 4562 nitrogen iron nickel chrome molybdenum alloy steel are welded to the plain carbon steel cold end rotor 22 via a bi-metallic weld procedure. There is disclosed herein a method for assembling the hot end rotor 24 to the cold end rotor 22. The method includes providing the cold end rotor 22 comprising a plain carbon steel, providing the hot end rotor 24 comprising a ceramic material, such as a ceramic casting, and providing a plurality of retainer elements 42 comprising a high alloy steel (e.g., type 4562 nitrogen iron nickel chrome molybdenum alloy steel). The method includes wrapping a circumferential exterior surface of the hot end rotor 24 with the ceramic fiber blanket 40 and positioning a plurality of groups 55 of a plurality of the retainer elements 42 circumferentially around the hot end rotor 24. The method includes connecting each of the plurality of retainer elements 42 to a circumferential exterior surface of the cold end rotor 22 (e.g., the upper flange area 22U) via one or more bimetallic welds between and joining the retainer elements 42 to the circumferential exterior surface of the cold end rotor 22.

Although the present invention has been disclosed and described with reference to certain embodiments thereof, it should be noted that other variations and modifications may be made, and it is intended that the following claims cover the variations and modifications within the true scope of the invention.

What is claimed is:

1. An insulation retaining assembly for a high temperature rotary pre-heater having a rotor including a cold-end rotor and a hot-end rotor, the insulation retaining assembly comprising:

a plurality of retainer elements radially restrained relative to the rotor, each of the plurality of retainer elements comprising:

a root end adapted to be held in fixed relationship to the cold-end rotor;

a distal end proximate to and in moveable relationship to the hot-end rotor; and an elongate axial portion extending between the root end and the distal end, the elongate axial portion being in moveable relationship with the hot-end rotor, wherein the distal end of each retainer element cooperate with one another to form a distal end circumferential expansion facilitating feature between adjacent distal ends for circumferential movement of adjacent distal ends relative to one another.

2. The insulation retaining assembly of claim 1, wherein each of the plurality of retainer elements has a first connection area at the root end and a second connection area at the distal end;

a plurality of groups of retainer elements, each of the plurality of groups has at least two of the plurality of retainer elements, adjacent ones of the plurality of retainer elements in each of the groups are secured to one another at the first connection area and the second connection area; and adjacent ones of the groups are secured to one another at the first connection area, thereby forming a closed loop about a central axis and adjacent ones of the groups are separate from one another outside of the first connection area so that each the groups is moveable in a circumferential direction about the central axis.

3. The insulation retaining assembly of claim 2, wherein each of the plurality of the retainer elements has an L-shaped configuration defining a first leg and a second leg, the second leg being shorter than the first leg and extending radially inward from the first leg.

4. The insulation retaining assembly of claim 3, wherein the first connection area is positioned on a first end of the first leg and the second connection area is positioned on a second end of the second leg.

5. The insulation retaining assembly of claim 1, wherein the distal end circumferential expansion facilitating feature is defined by a circumferential gap between the distal ends of adjacent retaining elements.

6. The insulation retaining assembly of claim 5, wherein the circumferential gap axially extends between elongate portions of adjacent retainer elements.

7. The insulation retaining assembly of claim 6, wherein a size of the circumferential gap between elongate portions of adjacent retainer elements changes in response to thermal expansion.

8. The insulation retaining assembly of claim 1, wherein the distal end circumferential expansion facilitating feature prevents the plurality of retainer elements from deflecting outward from the hot-end rotor.

9. The insulation retaining assembly of claim 1, wherein the distal end circumferential expansion facilitating feature prevents interference of the hot-end rotor with a refractory lining a housing of the rotary pre-heater.

10. The insulation retaining assembly of claim 9, wherein interference of the hot-end rotor with the refractory is prevented at temperatures of at least 2100 degrees Fahrenheit.

11. The insulation retaining assembly of claim 1, wherein the insulation retaining assembly encapsulates insulation surrounding the hot-end rotor.

12. The insulation retaining assembly of claim 1, wherein the root end is directly connected to the cold-end rotor.

13. The insulation retaining assembly of claim 12, wherein the direct connection is a weld.

14. The insulation retaining assembly of claim 2, wherein the plurality of groups of retainer elements collectively form a structurally stable arcuate section configured to withstand mechanical effects of thermal expansion.

* * * * *